United States Patent [19]

Harris

[11] 4,230,532

[45] Oct. 28, 1980

[54] OVEN DOOR

[75] Inventor: Edward Harris, Pittsburgh, Pa.

[73] Assignee: Koppers Company, Inc., Pittsburgh, Pa.

[21] Appl. No.: 57,891

[22] Filed: Jul. 16, 1979

[51] Int. Cl.[3] ..... C10B 25/12

[52] U.S. Cl. ..... 202/248; 202/246; 220/314

[58] Field of Search ..... 202/246, 248, 247, 245, 202/242, 262; 220/314

[56] References Cited

U.S. PATENT DOCUMENTS

| | | | |
|---|---|---|---|
| 2,154,545 | 4/1939 | Thwaits | 220/314 |
| 2,197,943 | 4/1940 | Potter | 202/248 |
| 3,567,590 | 3/1971 | Reinfeld et al. | 202/248 |

*Primary Examiner*—Norman Yudkoff

*Attorney, Agent, or Firm*—Donald M. MacKay; Herbert J. Zeh, Jr.; Oscar B. Brumback

[57] ABSTRACT

The oven door comprises a latching mechanism having a centrally located spring contained within a spring box to exert a force against said door. A pair of hinge links are pivotably connected to the door hinge shaft and to the spring box. A shaft link is keyed to said shaft and pivotably connected to a latch bar of a yoke type U configuration. A primary toggle link is located on either side of said spring box and pivotably connected on one end to said spring box and door hinge links and on the other end to the latch bar legs, means to limit rotation of primary toggle links and spring box around pivot connections is provided, a latching bracket is affixed to a stationary member for engaging latch bar to secure door to door chamber frame, and actuator means are provided for turning said shaft to open and close the door.

In a preferred embodiment a pair of secondary toggle links are located one on either side of spring box, and pivotably connected at one end to latch bar connections which are common to primary toggle links, and at other end they are connected to a stem yoke mounted between said secondary toggle links, said stem yoke having a clearance hole for accepting a stem affixed to door. In operation to open the door, simultaneously with rotaton of shaft 10, shaft link 32 rotates through bored hinge links 22 to disengage latch bar 26 from latch bracket 42, primary toggle links 24 cross center line of door 2 and threaded stem 12, and continue until restrained by nuts 18 and the exerted force of spring 14 is relieved a predetermined amount.

6 Claims, 8 Drawing Figures

OVEN DOOR

BACKGROUND OF THE INVENTION

In conventional coke oven doors located on the pusher side of a coke oven chamber, there is a small leveler bar door located near the top of the coking chamber. Such door is usually opened after fresh coal has been charged into a coking chamber, and a coal leveler bar is extended from the pusher machine into the coking chamber to level the top of the coal in the coking chamber.

In one instance, heretofore, the leveler bar door is equipped with vertically hung hinges, and a hand wheel mounted on a screw is turned to secure the door in place.

The present invention is an improved leveler door for coke ovens and door for other vessels closed to the atmosphere which can be hung without regard to gravity, which is easily opened and closed without turning a screw.

BRIEF DESCRIPTION OF THE INVENTION

Figure 1:
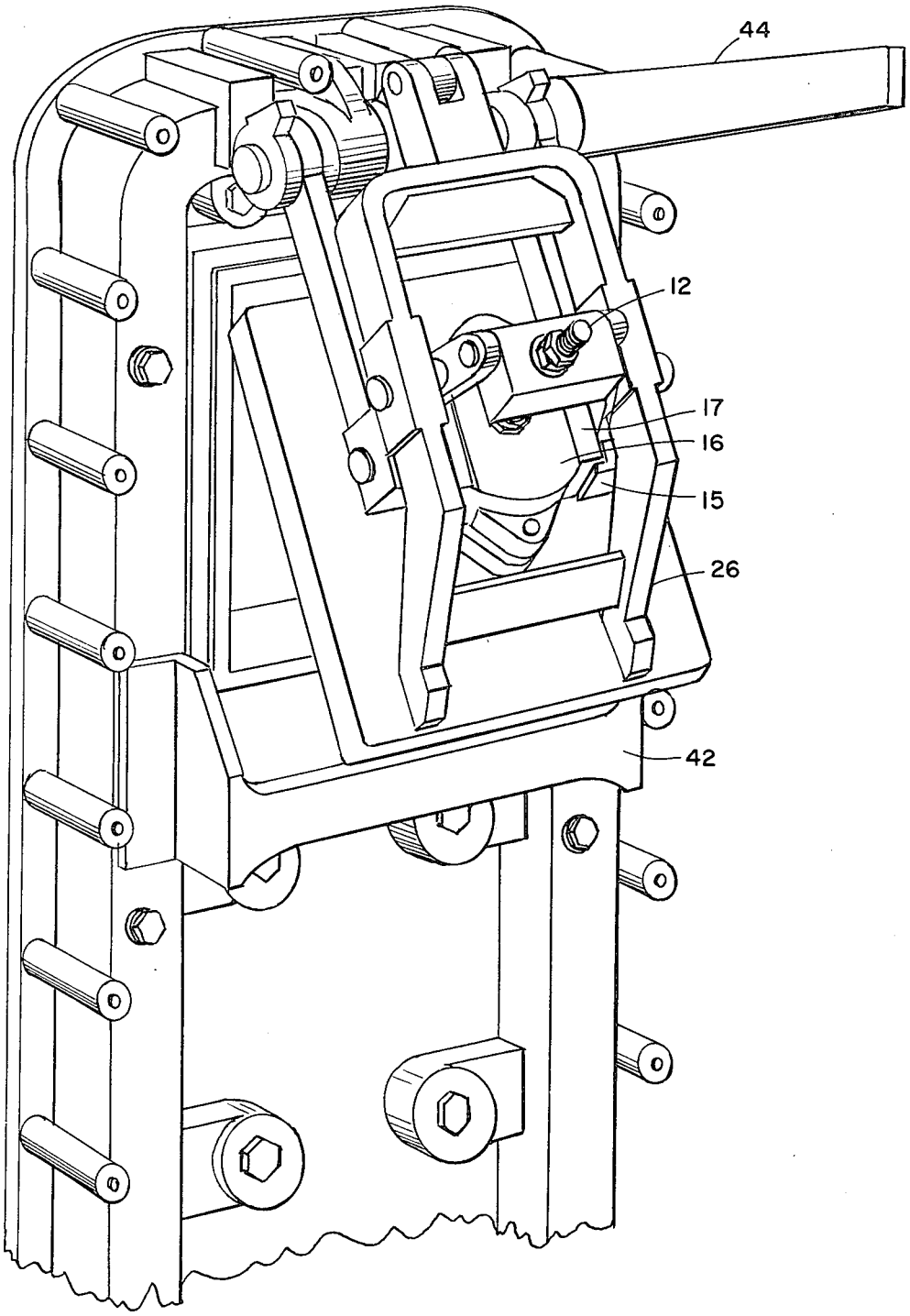
FIG. 1 is an isometric view of the leveler door and latching apparatus with the door in an open position.
Figure 2:
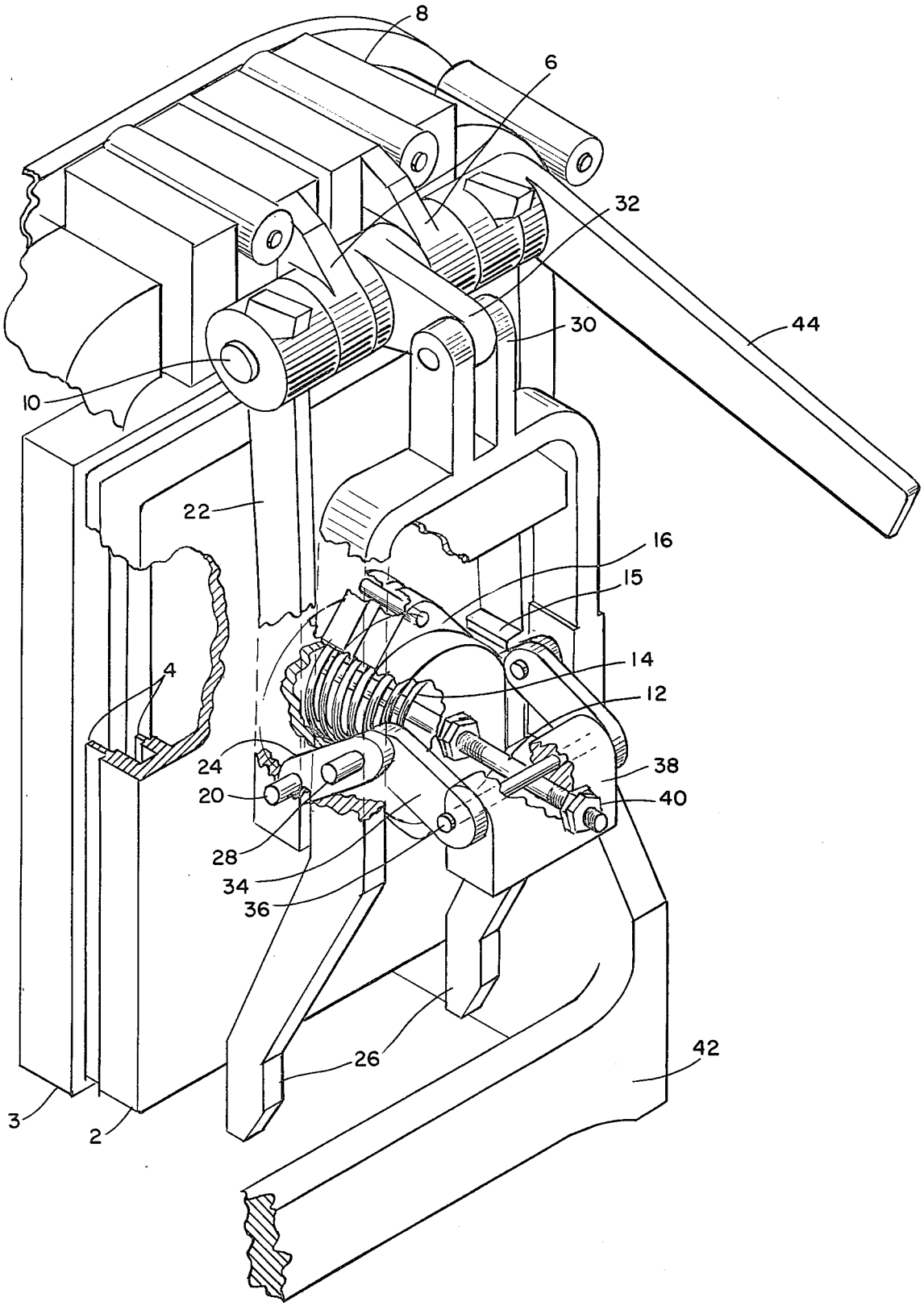
FIG. 2 is an isometric view of the closed door and latching apparatus in an open position with a partial cutaway to expose the spring box and sealing elements.
Figure 3:
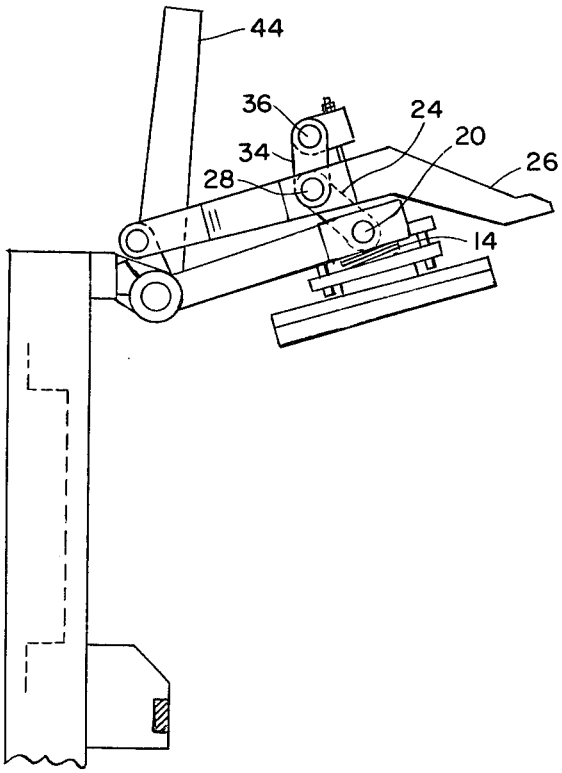
FIG. 3 is a side view of the door and latching apparatus with the door in an open position.
Figure 4:
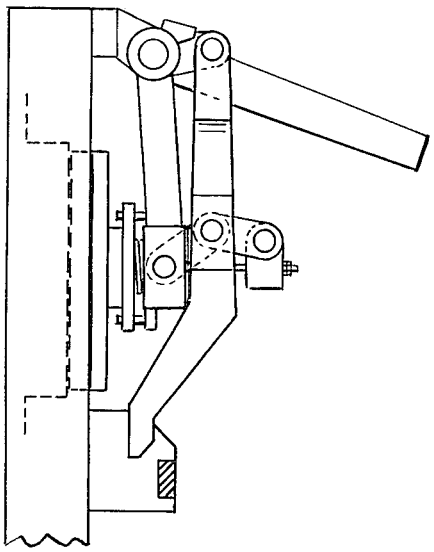
FIG. 4 is a side view of the door and latching apparatus with the door in an almost closed position.
Figure 5:
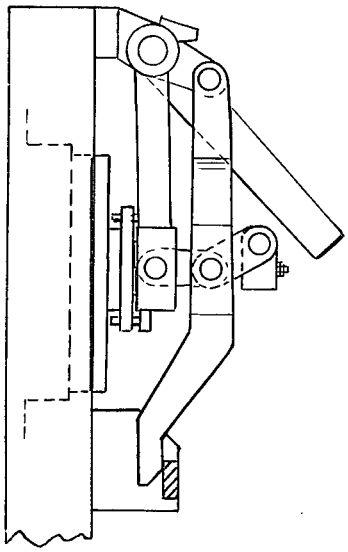
FIG. 5 is a side view of the door and latching apparatus with the door closed and latched.

Referring now to the drawings (FIG. 2) the coke oven leveler door and latching apparatus comprise a door 2 joined by hinge brackets 6 to a coke oven 8 by means of shaft 10. Rotation of actuator 44 through a limited arc opens and closes the door 2 by bringing it into contact with and removing it from contact with door frame 3. After the door 2 has contacted frame 3, further arcuate movement by actuator 44 urges the door into contact with the frame with a predetermined force.

To provide this force, the door has a centrally located spring 14 contained within a spring box 16. Connected to either side of said spring box is a hinge link 22 which is also rotated on to shaft 10. A latch bar of a yoke type U configuration 26 is pivotably affixed to said shaft 10 by a shaft link 32 keyed to shaft 10. Pivotably connected to the latch bar legs is one end of a primary toggle link 24 located on either side of said spring box 16 and the other end pivotably connected to the spring box 16 and door hinge links 22. Stop means 18 is provided to limit rotation of primary toggle links 24 and stop 15 is provided to limit rotation of spring box 16 around pivot points 20 and 28. A latching bracket 42 is affixed to a stationary member on the coke oven for engaging latch bar 26 to secure door. Actuator 44 is for turning said shaft 10 to open and close the door.

In a preferred embodiment a pair of secondary toggle links 34 are located one on either side of spring box, and pivotably connected at one end to latch bar connections which are common to primary toggle links 24, and at other end they are connected to a stem yoke 38 mounted between said secondary toggle links, the stem yoke having a clearance hole for accepting a stem 12 affixed to door 2.

In operation to open the door, simultaneously with rotation of shaft 10, shaft link 32 rotates relative to hinge links 22 to disengage latch bar 26 from latch bracket 42, primary toggle links 24 cross the center line of door 2 which passes threaded stem 12, and continue until restrained by nuts 18 and the exerted force of spring 14 is relieved a predetermined amount.

DETAILED DESCRIPTION OF THE PREFERRED EMBODIMENT

The spring box 16 with a clearance hole located at center to accept threaded stem 12 with locking nuts 18 when used in conjunction with door 2 and preloaded spring 14 allows for a predetermined gap between leveler door 2 and spring box 16. The spring box has two pivot holes, one on each side and in line, to accept pivot pins 20 which are mounted to door hinge links 22 and slipped through aperature in primary toggle links 24 to form a trunnion type connection. The door hinge links 22, one on either side of spring box, are free to rotate around a common shaft 10 on one end and are connected to spring box 16 by pivot pins 20 on other end. Incorporated in spring box 16 is a projection 17 to limit rotation about trunnion type connection of said spring box by contacting stop 15 incorporated in hinge link 22. The two primary toggle links 24, one on each side of spring box 16 are connected to latch bar 26 by trunnion type connection pivot pins 28. The pivot pins 28 are approximately centered between latch portion and shaft link portion of latch bar. Incorporated at shaft link end 32 of latch bar is a clevis type connection 30 with a pivot pin which is connected to shaft link 32.

Two secondary toggle links 34, one on each side of spring box 16 are connected at one end by pivot pins 28 incorporated in latch bar 26 which are common to primary toggle links 24, and at other end to pivot pins 36 incorporated in stem yoke 38.

Stem yoke 38 has a clearance hole to accept threaded stem 12 which is affixed to center of door 2 and is secured in position on threaded stem by lock nuts 40. A latching bracket 42 is affixed to oven 8 and located at latch end of latch bar 26. An actuator lever 44 is rotated about shaft 10 to open and close the door. When door is closed and latch bar 26 is engaged in latching bracket 42, door exerts a predetermined force against oven door frame 3, and a reaction force through trunnion type connection 20 is spring box 16 due to preloaded spring mounted between door and spring box.

The reaction force is exerted through primary toggle links 24 to latch bar pivot connections 26 which when latched are positioned off perpendicular center line with respect to plane of door 2. Toggle links 24 and 34 are restrained while latched, by stops 15 incorporated in door hinge links 22. The force exerted by offset primary toggle links will cause rotational moments through latch bar 26 in direction of latch bracket 42. The latch bar is utilized as a beam, restrained on both ends by means of latch bracket 42 and keyed shaft link 32 with exerted force applied at center. Thus, when used in conjunction with primary toggle links 24, positive locking is assured since latch bar 26 rotational moments counter rotation required to open door. Door hinge links 22 in conjunction with primary toggle links 24 and keyed shaft link 32 take a geometric form similar to a parallelogram. The length of primary toggle links 24 and keyed shaft link 32 in conjunction with pivot point geometry of clevis type connection 30 and pivot pins 20 and 28 assure proper unlatching and latching of door 2.

To unlock and open the door, the mechanical sequence is as follows: Shaft 10 in conjunction with keyed shaft link 32 is rotated through bored hinge brackets 6 by means of the rotation of actuator 44. Simultaneously with the rotation of shaft 10 the following motions occur. Shaft link 32 rotates relative to bored door hinge links 22 while latch bar 26 is engaged with latch bracket 42. Due to the exerted force by spring 14 between door 2 and spring box 16, door and door hinge links 22 remain in position relative to oven door frame 3 while latch bar 26 by movement relative to the face of door 2 is disengaging from latch bracket 42 in a motion parallel to plane of door by means of the rotation of driven keyed shaft link 32. While latch bar 26 is disengaging, primary toggle links 24 cross center line of door 2 and threaded stem 12. Due to geometry of toggle linkage formed by links 24 and 34, exerted spring force of spring 14 is relieved a predetermined amount and threaded stem locking nuts 18 contact top surface of spring box 16. Primary toggle links 24 continue rotating about trunnion type pivot connections 20 and 28 until toggle links are restrained by stop nuts 18 incorporated in stem 12. At this time, latch bar 26 is completely disengaged from latch bracket 42 and door and latching mechanism as an assembly will rotate with common shaft 10 to a predetermined full open position.

Door frame 3 and/or stop incorporated in latch bracket 42 is utilized as a means for restricting rotation of door and latching mechanism assembly about common shaft 10 while closing and prior to latching sequence.

Sequential latching mechanical motions of door and latching mechanism assembly will be opposite the unlatching sequence outlined above. Included in door and latching mechanism is a pair of secondary toggle links 34 which in conjunction with primary toggle links 24 form an elbow like configuration joined approximately at the center of latch bar common pivot pins 28. Complete toggle configuration is restrained on one end by trunnion type pivot pins 36 incorporated in stem yoke 38. The stem yoke is secured to threaded stem 12 (affixed to door 2) by threaded locking nuts 40. Due to exerted spring force between spring box 16 and door 2, offset toggle links exert rotational moments in direction of latch bracket 42 while door is in latched position. During unlatching sequence, latch bar 26 is utilized as driving force. Thus, while latch bar is moving in plane parallel to door, latch bar common pivot connections 28 cross center line of door 2 and threaded stem 12. Toggle links 24 and 34 straighten as pivot connections 28 cross center of door and stem, and through further motion form an elbow type configuration in opposite direction, restrained by nuts 18 incorporated in stem 12. Simultaneously with the above unlatching sequence, the exerted spring force between spring box 16 and door 2 is relieved a predetermined amount.

The remaining spring force is exerted through threaded stem 12 and locking nuts 18 to stem yoke 38 and pivot connections 28 and 36 in secondary toggle links 34 and thus latch bar 26 is restrained in position relative to door 2 by rotational moments which counter rotation required to close door. As a result of the combined action of the primary and secondary toggles 24 and 34, door 2 and latching mechanism may be operated in any position relative to the force of gravity. When door and latching apparatus is hung in a vertical or horizontal plane relative to the force of gravity, the door and latching mechanism may be used without secondary toggle links 34.

The spring box 16 can be eliminated by locating trunnion type connections 20 within door proper, and spring 14 between door 2 and stem yoke 38.

Figure 6:
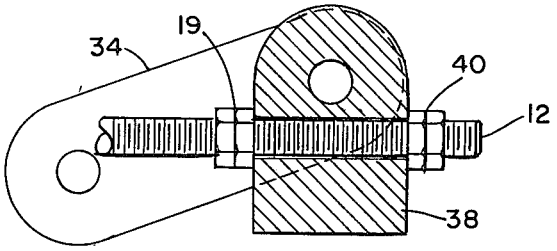
FIG. 6 is a side view of a stem yoke.

As an alternate embodiment the door can be used as a pressure relief door which can be opened by an explosion or pressure surge within an enclosed chamber. This is accomplished by locating additional nuts 19 to spring stem 12 on the underside of stem yoke 38 as shown in FIG. 6. The force exerted by a pressure surge or explosion is transmitted through door 2 and threaded stem 12 to underside of yoke 38 by means of nuts 19. Simultaneously spring 14 will compress and door 2 and stem 12 will exert force to underside of yoke 38 to cause rotational moments through secondary toggle links 34 in direction of open position.

Figure 7:
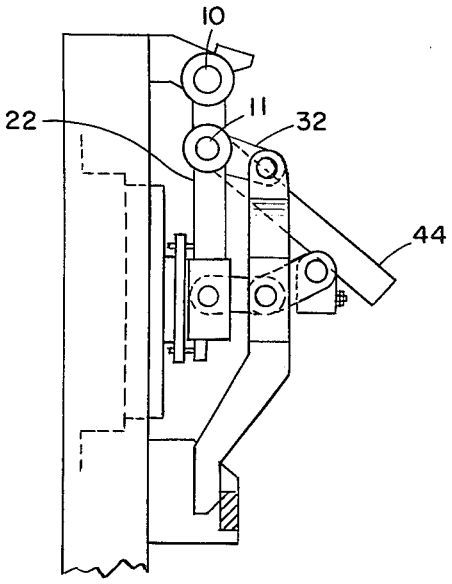
FIG. 7 is a side view of a latching apparatus operating from a different pivot connection.

As an alternate embodiment, the latching mechanism can be operated from a shaft other than pivot connection 10. This is accomplished as shown in FIG. 7 by having a shaft 11 mounted between door hinge links 22. Shaft link 32 and actuator 44 are keyed to said shaft 11.

Figure 8:
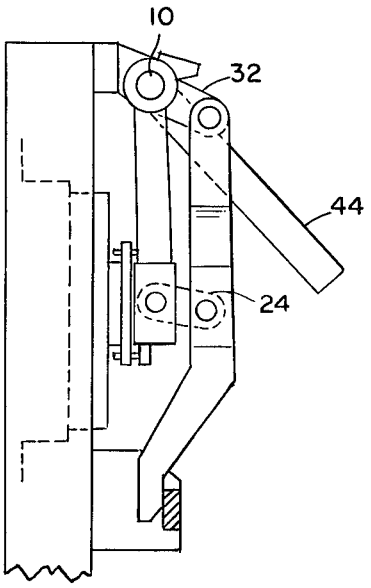
FIG. 8 is a side view of a latching apparatus employing a single pair of toggle links.

Finally, as an alternative embodiment the use of a single pair of toggle links 24 (one on each side of spring box) is shown in FIG. 8.

While the invention has been illustrated by the preferred embodiments, numerous variations will occur to those of ordinary skill which will be within the true scope of this invention. Accordingly, the invention is to be limited only by the appended claims.

What is claimed:

1. In a pressure chamber such as a coke oven or the like having a hinged door, actuator means for opening and closing the door, a centrally located spring contained within a spring box for exerting a force against said door, a latch bar on the door and a latching bracket on the pressure chamber, the improvement which comprises in combination:

(a) a pair of hinge links one on each side of the spring box pivotably connected to the door hinge shaft and to the spring box, (b) a latch bar of a yoke type U configuration pivotably connected to said hinge links by means of a shaft or pivotably connected to said hinge shaft, (c) a primary toggle link on either side of said spring box pivotably connected on one end to said spring box and door hinge links, and pivotably connected on the other end to latch bar legs, and (d) means to limit rotation of primary toggle links and spring box around pivot connections.

2. The pressure chamber of claim 1 wherein a secondary pair of toggle links, one on each side of spring box, are connected at one end to latch bar by connections which are common to primary toggle links, and connected at other end to a stem yoke mounted between said secondary toggle links.

3. The pressure chamber of claim 2 wherein stop means are affixed to the underside of said stem yoke to provide a pressure release door.

4. The pressure chamber of claim 1 wherein the latch bar is pivotably connected to a shaft pivotably connected to said hinge links.

5. The pressure chamber of claim 2 wherein the stem yoke has a threaded stem passing through a clearance hole in said yoke, said threaded stem containing lock nuts as stops.

6. The pressure chamber of claim 1 wherein the door has more than one sealing element.

* * * * *